US006138588A

United States Patent [19]

Chapman et al.

[11] Patent Number: 6,138,588

[45] Date of Patent: Oct. 31, 2000

[54] METHOD OF OPERATING A COAL-FIRED FURNACE TO CONTROL THE FLOW OF COMBUSTION PRODUCTS

[75] Inventors: Paul J. Chapman; Michael L. Kaplan, both of Windsor; Majed A. Toqan, Avon, all of Conn.

[73] Assignee: ABB Alstom Power Inc., Windsor, Conn.

[21] Appl. No.: 09/371,453

[22] Filed: Aug. 10, 1999

[51] Int. Cl.[7] ..... F23C 5/32; F23N 5/02; F23D 1/00

[52] U.S. Cl. ..... 110/347; 431/9; 431/10; 431/12; 431/173; 110/190

[58] Field of Search ..... 431/12, 10, 9, 431/173, 75, 189; 110/190, 213, 214, 347

[56] References Cited

U.S. PATENT DOCUMENTS

| | | | |
|---|---|---|---|
| 4,150,631 | 4/1979 | Frey et al. | 110/186 |
| 4,296,727 | 10/1981 | Bryan | 126/116 A |
| 4,425,855 | 1/1984 | Chadshay | 110/263 |
| 4,435,149 | 3/1984 | Astheimer | 431/12 |
| 4,672,900 | 6/1987 | Santalla et al. | 110/264 |
| 4,715,301 | 12/1987 | Bianca et al. | 110/347 |
| 4,887,958 | 12/1989 | Hagar | 431/12 |
| 5,315,939 | 5/1994 | Rini et al. | 110/264 |
| 5,626,085 | 5/1997 | Donais et al. | 110/188 |
| 5,634,412 | 6/1997 | Martin et al. | 110/101 |
| 5,666,889 | 9/1997 | Evens et al. | 110/190 |
| 5,746,143 | 5/1998 | Vatsky | 110/297 |
| 5,794,549 | 8/1998 | Carter | 110/347 |

*Primary Examiner*—Pamela Wilson
*Assistant Examiner*—Ken B. Rinehart
*Attorney, Agent, or Firm*—Russell W. Warnock

[57] ABSTRACT

A method of operating a pulverized coal-firing furnace is provided which includes injecting air from an upper compartment generally in opposition to a swirling fireball. The method also provides the step of sensing a temperature characteristic of one side of a convection pass of the furnace. The sensed value, in accordance with the method of the present invention, is then evaluated to determine if the sensed value of the temperature characteristic exceeds an allowable value. In response to a determination that the temperature characteristic exceeds the allowable value, the momentum of the air injected through the upper air compartment is changed. After the step of changing the momentum of the air injected through the upper air compartment, the temperature characteristic of the one convection pass location is sensed to obtain a post adjustment value of the temperature characteristic and compared to an allowable value.

7 Claims, 6 Drawing Sheets

METHOD OF OPERATING A COAL-FIRED FURNACE TO CONTROL THE FLOW OF COMBUSTION PRODUCTS

BACKGROUND OF THE INVENTION

The present invention relates to a method of operating a fossil fuel-fired furnace and, more particularly, to a method of operating a pulverized coal-fired furnace so as to control the flow of combustion products therein. The present invention also relates to a fossil fuel-fired furnace such as a pulverized coal-fired furnace.

U.S. Pat. No. 4,672,900 to Santalla et al. discloses an arrangement for a tangentially-fired, pulverized coal-burning furnace in which one or more nozzles are mounted in the upper portion of the combustion chamber of the furnace to eject secondary air in opposition to the swirling fireball flowing in the upper portion of the combustion chamber. The secondary air ejected by the nozzle or nozzles in the upper portion of the combustion chamber is ejected in a manner such that the secondary air provides equal but opposite angular momentum to the angular momentum of the fuel and air introduced into the lower portion of the combustion chamber. Such an arrangement, according to the patent, results in the elimination of a rotating pattern of the products of combustion which reduces the probability of ash particles migrating to the boundary walls (slagging) while simultaneously providing conditions ideal for flowing into the convection section of the furnace.

It would be desirable to obtain the benefits of the arrangement disclosed in the Santalla et al. patent in other furnace configurations such as a tangential firing furnace configuration in which there is either no separated overfire air compartment or the separated overfire air compartment is not operated to influence the swirling fireball in the same manner as the separated overfire air compartment of the Santalla et al. patent. In such other furnace configurations, the aerodynamic behavior of the swirling fireball as well as other conditions in the furnace may complicate a direct application of an equal and opposite injection of secondary air from a separated overfire air compartment. For example, a mere reconfiguration of several air nozzles in the lower region of the furnace to inject air in an oppositional manner to the swirling fireball may merely result in a change in rotation of the swirling fireball, thus failing to reap the benefits presumably associated with an elimination of a rotating pattern of combustion.

Moreover, there are costs associated with an effort to achieve complete suppression of the rotation of the swirling fireball. Interventions such as injecting additional volumes of air in opposition to the swirling fireball, adjustment of the tilt orientation of the injected air or reduction of the load to completely suppress the formation of any non-uniform (rotational) flow of the flue gas from the fireball engender greater operating expense or less efficiency. Also, the materials and construction of the portion of the furnace which handle the non-uniform flue gas flow such as the convective pass must necessarily be constrained to those materials and construction which can withstand the maximum or peak temperature which may be experienced due to an unmodulated non-uniform flow of flue gas in the convective pass. Thus, the industry would benefit from a method to modulate or control the non-uniform flow of flue gas into the convective pass of a furnace, thereby mitigating or eliminating the undesirable effects of non-uniform flow such as, for example, a maldistribution of energy absorption by the convective heat exchange surface within the convective pass as a result of the differences in the local heat transfer coefficients. Additionally, the industry would benefit from an approach to configuring the tangential firing operation of a pulverized coal-fired furnace that would fully optimize the combustion process benefits associated with control of the swirling fireball created in a tangential firing process.

SUMMARY OF THE INVENTION

The present invention provides an improvement for configuring the tangential firing operation of a pulverized coal-fired furnace which more fully optimized the combustion process benefits thereof which may be obtained by control of the swirling fireball in the furnace. Moreover, the improvement provided by the present invention is particularly useful in a furnace including a tangential firing furnace configuration in which there is either no separated overfire air compartment or the separated overfire air compartment is not operated to influence the swirling fireball.

According to one aspect of the present invention, there is provided a method for operating a pulverized coal-fired furnace having a combustion chamber operable to combust fuel in a combustion process which produces flue gas and a convection pass through which the flue gas flows upon exiting the combustion chamber. The method for operating the furnace includes tangentially firing fuel from at least one of the series of lower compartments of the furnace into the combustion chamber at an offset from a diagonal passing through a pair of opposed corners of the combustion chamber. The method also includes tangentially introducing air from the series of lower compartments into the combustion chamber along a direction which is offset to the diagonal on the same side thereof as the fuel firing offset direction, the collective amount of air tangentially introduced through the lower compartments being less than the stoichiometric amount of air required for complete combustion of the fuel tangentially fired into the furnace such that the fuel and air create a swirling fireball in the combustion chamber.

The method for operating the furnace further includes injecting air from the at least one upper compartment generally in opposition to the swirling fireball along a direction which is offset to the other side of the diagonal. Thereafter, the method provides the step of sensing a temperature characteristic of one side of the convection pass, the temperature characteristic varying as a function of the temperature of the one convection pass location. The sensed value, in accordance with the method of the present invention, is then evaluated in a step of determining if the sensed value of the temperature characteristic exceeds an allowable value.

The method for operating the furnace additionally includes, in response to a determination that the temperature characteristic exceeds the allowable value, changing the momentum of the air injected through the at least one upper air compartment. Moreover, the method includes, after the step of changing the momentum of the air injected through the at least one upper air compartment, sensing the temperature characteristic of the one convection pass location to obtain a post adjustment value of the temperature characteristic and subsequently determining if the post adjustment value exceeds the allowable value.

According to one feature of the method for operating a pulverized coal-fired furnace of the present invention, sensing the temperature characteristic of the one convection pass location preferably includes sensing the instantaneous temperature of the convection pass location. Also, the step of determining if the temperature characteristic exceeds an allowable value preferably includes comparing the difference between the one convection pass location temperature and a peak temperature to a pre-established buffer difference which represents the smallest acceptable difference between the convection pass location temperature and the peak temperature which can be permitted as the convection pass temperature increases in the direction of the peak temperature. Moreover, the step of changing the momentum of the air injected through the at least one upper air compartment preferably includes increasing at least one of the yaw angle and the volume of the air injected by the at least one upper air compartment if the one convection pass location temperature-to-peak temperature difference is less than the buffer difference. Furthermore, it is preferred that the step of sensing the temperature characteristic of the one convection pass location and subsequently determining if the post adjustment value of the temperature characteristic exceeds the peak value includes iteratively re-sensing the one convection pass location temperature, re-calculating the one convection pass location temperature-to-peak temperature difference to obtain a revised temperature difference, further increasing at least one of the yaw angle and the volume of the air injected by the at least one upper air compartment, and re-comparing the revised temperature difference to the buffer difference until the revised temperature difference is greater than the buffer difference.

According to another aspect of the present invention, there is provided a pulverized coal-fired furnace having a combustion chamber, a convection pass, and at least one fuel nozzle for tangentially firing fuel from one of a series of lower compartments into the combustion chamber at an offset from a diagonal passing through a pair of opposed corners of the combustion chamber. The furnace also includes a plurality of air nozzles each for tangentially introducing air from a respective one of the series of lower compartments into the combustion chamber along a direction which is offset to the diagonal on the same side thereof as the fuel firing offset direction. The collective amount of air tangentially introduced through the lower compartments is less than the stoichiometric amount of air required for complete combustion of the fuel tangentially fired into the furnace such that the fuel and air create a swirling fireball in the combustion chamber.

The furnace further includes at least one air nozzle for injecting air from the at least one upper compartment generally in opposition to the swirling fireball along a direction which is offset to the other side of the diagonal. Additionally, the furnace includes means for sensing a temperature characteristic of one side of the convection pass, the temperature characteristic varying as a function of the temperature of the one convection pass location. The furnace further includes means for determining if the sensed value of the temperature characteristic exceeds an allowable value. Moreover, the furnace includes means for changing the momentum of the air injected through the at least one upper air compartment in response to a determination that the temperature characteristic exceeds the allowable value, the means for sensing the temperature characteristic of the one convection pass location being operable to obtain a post adjustment value of the temperature characteristic after a change in the momentum of the air injected through the at least one upper air compartment and the means for determining being operable to subsequently determine if the post adjustment value exceeds the allowable value.

DETAILED DESCRIPTION OF THE PREFERRED EMBODIMENTS

Figure 1:
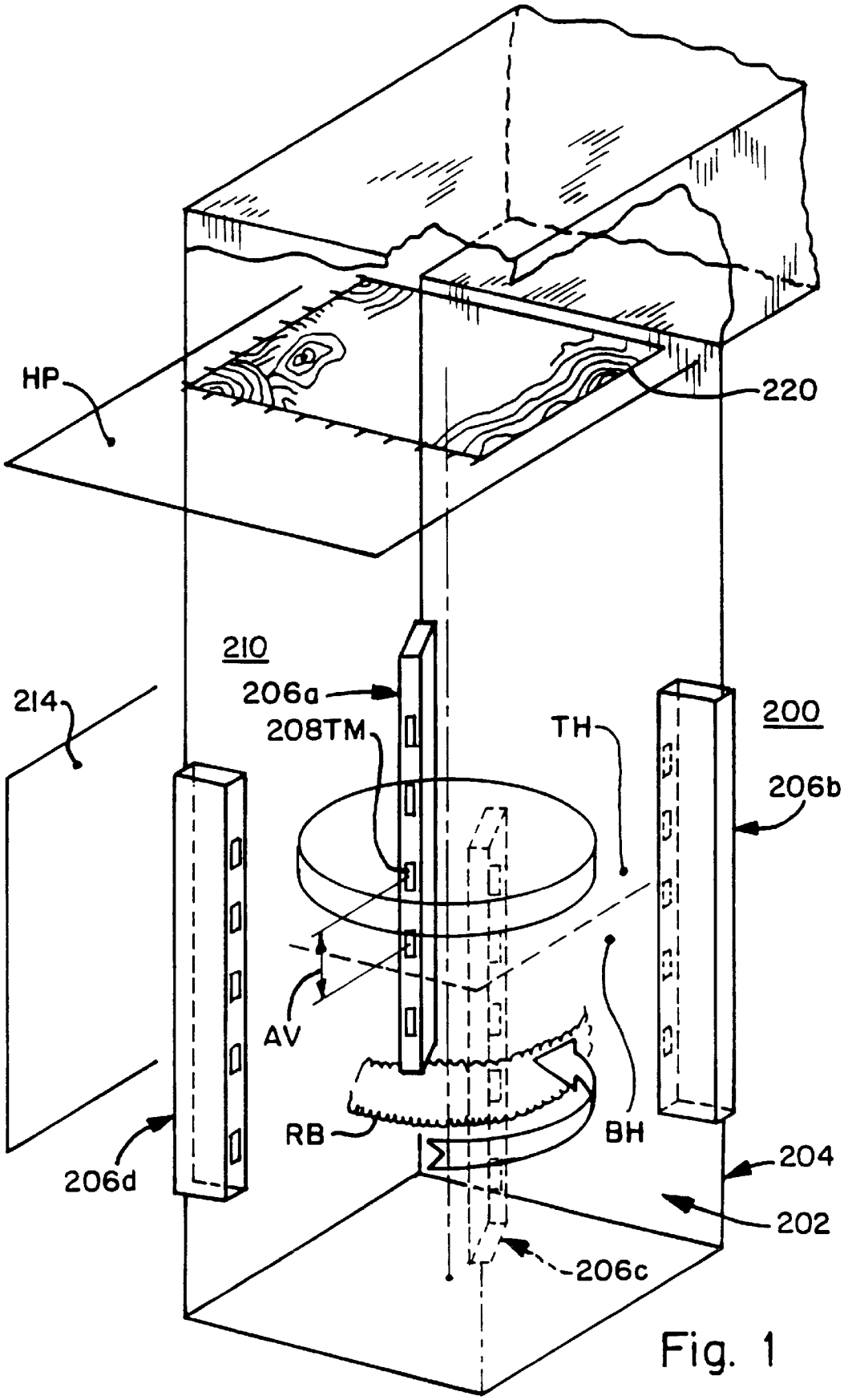
FIG. 1 is a perspective schematic view, in partial vertical section, a pulverized coal-firing furnace operable in accordance with the method of the present invention.

As seen in FIG. 1, a fossil fuel-fired furnace is shown which is operable in accordance with the method of the present invention. The fossil fuel-fired furnace includes a concentric tangential firing system and a plurality of walls embodying therewithin a burner region. The concentric tangential firing system is generally designated as 200 in FIG. 1 and is operable in a combustion chamber forming a burner region 202 of a fossil fuel-fired furnace 204 which may be a pulverized coal-fired furnace. The burner region 202 defines a longitudinal axis BL extending vertically through the center of the burner region.

The combustion chamber forming the burner region 202 has four corners each substantially equidistant from adjacent corners such that the combustion chamber has a substantially square cross section. In the four corners of the combustion chamber are arranged a first windbox 206A, a second windbox 206B, a third windbox 206C, and a fourth windbox 206D. The first windbox 206A is generally circumferentially intermediately disposed between the second windbox 206B and the fourth windbox 206D as viewed in a circumferential direction relative to the burner region longitudinal axis BL such that the first windbox 206A is at a generally equal circumferential spacing from each respective one of the second windbox 206B and the fourth windbox 206D. The third windbox 206C is generally circumferentially intermediately disposed between the second windbox 206B and the fourth windbox 206D on the respective other side of these windboxes as viewed in the circumferential direction such that the third windbox 206C is at a generally equal circumferential spacing from each respective one of the second windbox 206B and the fourth windbox 206D.

The first windbox 206A and the third windbox 206C define a first pair of juxtaposed windboxes in juxtaposed relation to one another (i.e., the pair of windboxes are disposed on a diagonal DD passing through the longitudinal axis BL). The second windbox 206B and the fourth windbox 206D define a second pair of juxtaposed windboxes in juxtaposed relation to one another.

The windboxes 206A–206D each comprise a plurality of compartments which will now be described in greater detail with particular reference to one of the windboxes (the first windbox 206A) which is designated for this descriptive purpose as a representative windbox, it being understood that the other windboxes 206B, 206C, and 206D are identical in configuration and operation to this representative windbox. The first windbox 206A includes a series of lower compartments 208 each for introducing therethrough fuel, air, or both fuel and air such that a combination of air and fuel is introduced into the combustion chamber via this series of lower compartments. It is to be understood, however, that one or more of the windboxes 206A–206D can alternatively be configured such that its series of lower compartments only introduce a selected one of fuel or air into the burner region 202, as desired. The lower series of compartments 208 extend into the bottom half BH of the furnace 204 in a vertical arrangement with the series of lower compartments 208 being successively located one below another in an extent from a topmost one of the lower compartments, designated the topmost lower compartment 208TM, to a bottommost one of the lower compartments.

The first windbox 206A additionally includes at least one upper compartment for injecting air into the combustion chamber. The first windbox 206A is shown, by way of example, as having two such upper compartments 210 arranged at a vertical spacing from one another. As best seen in FIG. 1, the lowermost one of the two upper compartments 210 is disposed above the topmost lower compartment 208TM of the series of lower compartments 208 at a relative disposition thereto characterized by a vertical spacing of; for example, a spacing equal to the average spacing AV between any given lower compartment 208 and an adjacent lower compartment. In any event, the vertical spacing between the topmost lower compartment 208TM and the respective closest upper compartment 210 preferably lies in a spacing range between a contiguous disposition in which there is no or only a relatively negligible spacing to a more spaced apart disposition which is no more than twice the average spacing AV between any given lower compartment and an adjacent lower compartment.

Figure 2:
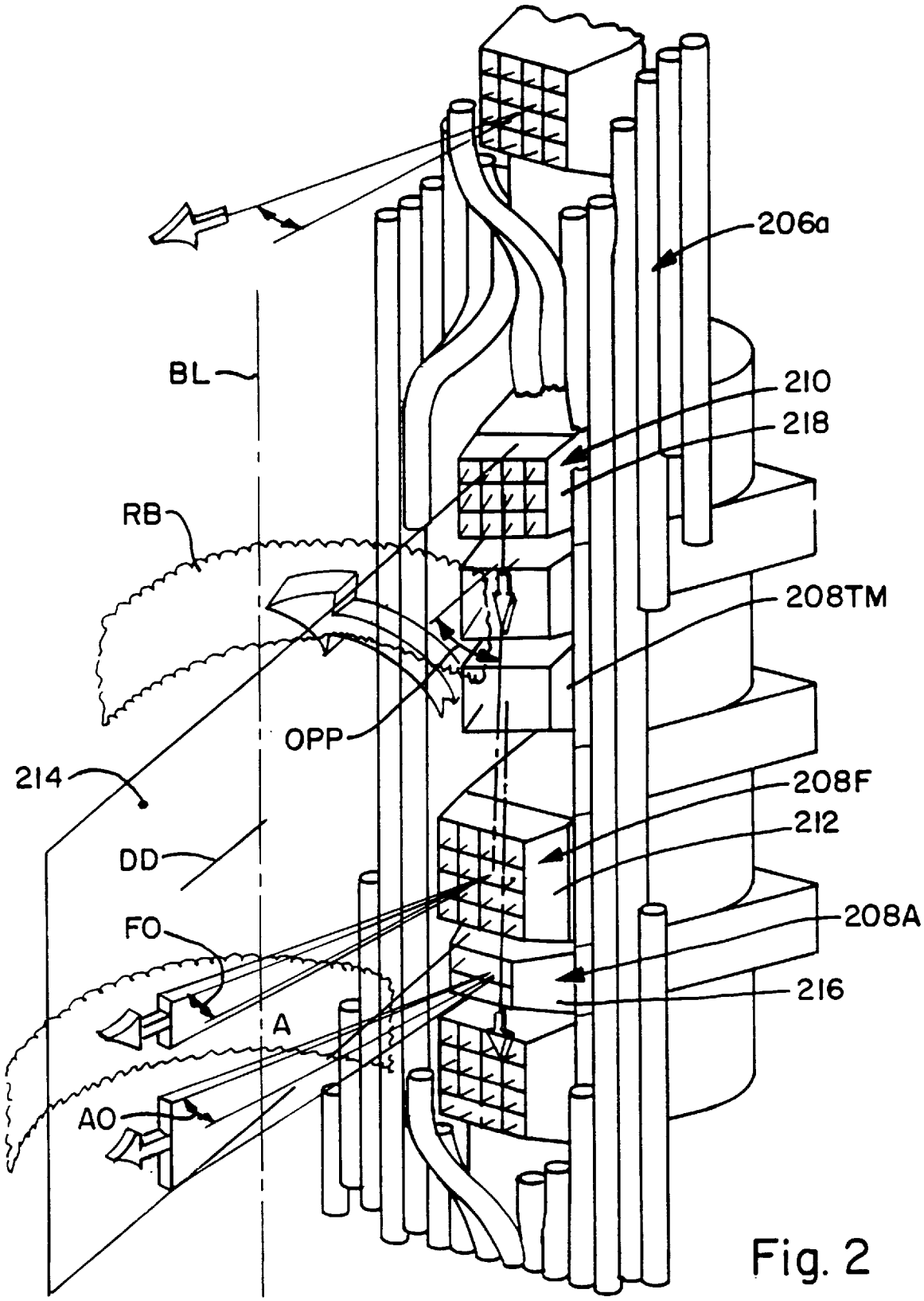
FIG. 2 is an enlarged perspective view of one of the corner windboxes of the furnace shown in FIG. 1 and schematically showing a rotating fireball in the furnace.

The first windbox 206A further includes, as seen in FIG. 2, a plurality of fuel nozzles 212 each suitably mounted in a respective one of the lower compartments 208 for tangentially firing fuel into the combustion chamber. One of the fuel nozzles 212 is representatively shown in its mounted disposition in a representative one of the lower compartments 208, hereinafter designated as the lower compartment 208F. The fuel nozzle 212 disposed in the lower compartment 208F fires fuel in a direction tangential to a fireball RB that rotates or swirls generally about the longitudinal axis BL of the burner region 202 while flowing upwardly therein. The tangential fuel firing direction, hereinafter designated the offset fuel firing direction FO, is at an angle from the diagonal DD. The diagonal DD lies in a plane 214 and, as noted, passes through the respective juxtaposed pair of opposed corners 206A, 206C of the combustion chamber.

The first windbox 206A further includes at least one air nozzle 216 for introducing air from a respective one of the lower compartments 208, hereinafter designated the lower compartment 208A, into the combustion chamber tangential to the rotating fireball RB. The air nozzle 216 introduces air along an air offset direction AO which is offset from the diagonal DD to the same side thereof as the offset fuel firing direction FO (in other words, the direction from the diagonal DD to the offset fuel firing direction FO and to the air offset direction AO is the same— counterclockwise as seen in FIG. 2). The offset fired fuel and air create and sustain the swirling or rotating fireball RB in the combustion chamber. Additionally, the air collectively introduced via the air nozzle 216 mounted in the lower compartment 208A as well as air introduced via any other lower compartment 208 is in an amount less than the amount required for complete combustion of the fuel fired into the burner region 202 such that the portion of the burner region 202 associated with the lower compartments 208 is characterized by a sub-stoichiometric combustion condition.

An opposition air nozzle 218, as best seen in FIG. 2, is mounted in the upper compartment 210 for injecting air from the upper compartment 210 generally in opposition to the swirling fireball RB along an opposition offset direction OPP which is offset to the opposite side of the diagonal DD as the side of the diagonal DD to which the offset fuel firing direction FO and the air offset direction AO are offset. The opposition air nozzle 218 injects air in a manner such that the injected air promotes the evolution of the swirling fireball RB into an upward flow in the top half TH of the furnace characterized by a maximum variation of no more than thirty percent between the instantaneous vertical velocities of the portions of the upward flow as measured across a horizontal plane HP in the top half TH of the furnace. An instantaneous vertical velocity of the upward flow of the rotating fireball RB is to be understood as the velocity (measurable in feet per second or meters per second, for example) of a given constituent element of the rotating fireball RB, in a direction parallel to the longitudinal axis BL of the burner region 202. The given constituent element may comprise uncombusted or combusted fuel or air or any product of the combustion of the fuel and air.

Figure 3:
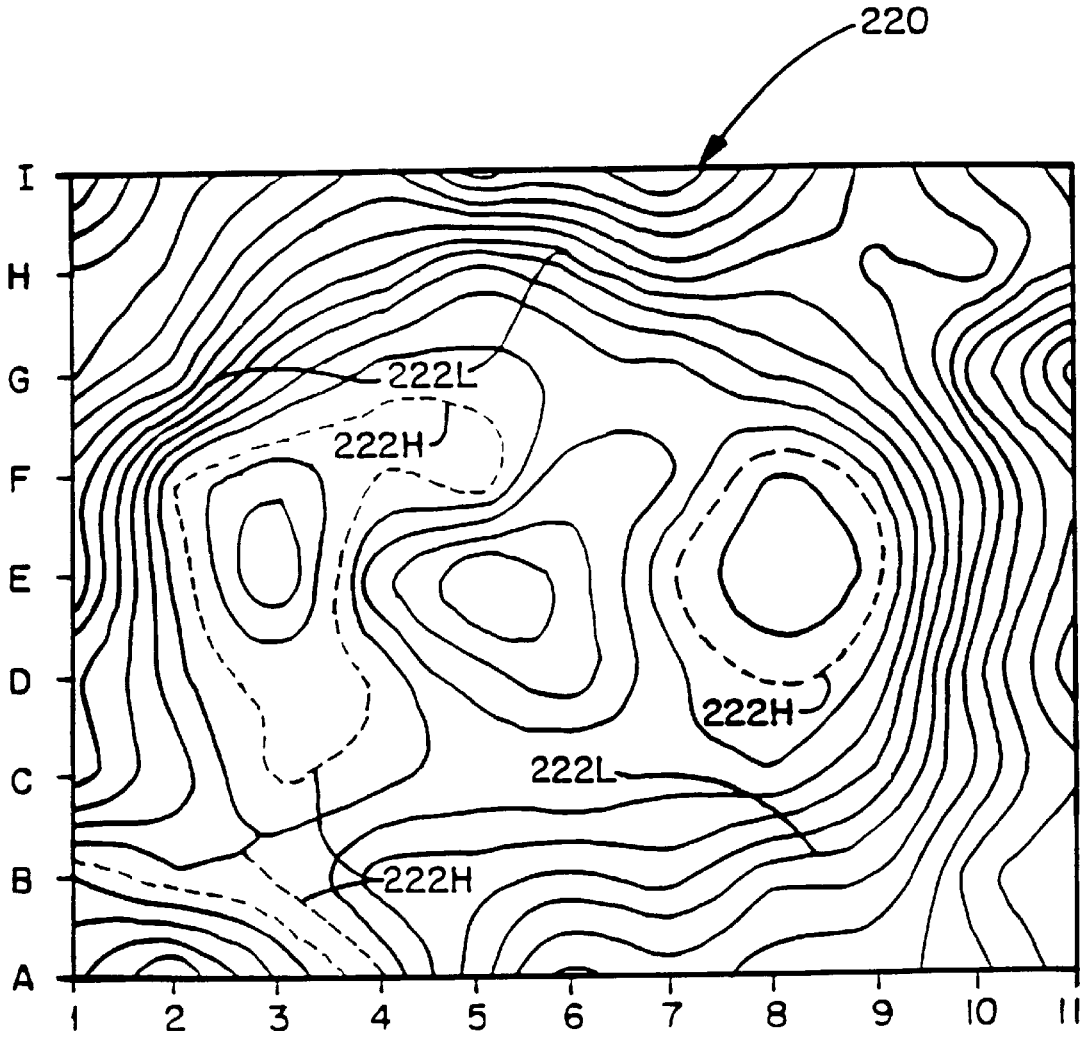
FIG. 3 is a schematic plan view of instantaneous vertical velocity contours of the heat flow in the furnace shown in FIG. 1 taken along a horizontal furnace outlet plane.

The rotating fireball RB thus exhibits a cross section of instantaneous vertical velocities as viewed across any selected transverse viewing area extending transversely across the region of the furnace volume 202 in which the rotating fireball RB is flowing. FIGS. 2 and 3 illustrate an imaginary representation of one such transverse view which yields a cross section of instantaneous vertical velocities of the rotating fireball RB. This imaginary representation of a cross section of instantaneous vertical velocities of the rotating fireball RB is designated as a vertical velocity slice 220 which is a transverse view of the rotating fireball RB delineated by the planar area formed by the intersection of the furnace 204 and the horizontal plane BP, as shown in FIG. 1.

In the enlarged view of the vertical velocity slice 220 illustrated in FIG. 3, it can be seen that a number of instantaneous vertical velocities which are the same as other instantaneous vertical velocities or, as desired, within a predetermined tolerance range of a common instantaneous vertical velocity value, are collectively graphically represented as a respective contour 222. The values of the instantaneous vertical velocities as represented by the contours 222 may comprise measured, simulated, predicted, or modeled values of the instantaneous vertical velocities. Moreover, these values need not be absolute values but can be, instead, values which correspond to each other relatively—i.e., according to a predetermined function. One of the contours 222, shown in broken lines and hereinafter denominated as the contour 222H, has been designated as a contour representing several individual instantaneous vertical velocities, each at a different location on the horizontal plane BP, which share a common value—namely, the relatively highest value-within the vertical velocity slice 220. Another one of the contours 222, hereinafter denominated as the contour 222L, has been designated as a contour representing several individual instantaneous vertical velocities, each at a different location of the horizontal plane HP, which share a different common value—namely, the relatively lowest value of the instantaneous vertical velocity within the vertical velocity slice 220. In accordance with the method of the present invention, then, the maximum variation between the relatively highest value of the instantaneous vertical velocity represented by the contour 222H and the relatively lowest value of the instantaneous vertical velocity represented by the contour 222L is not greater than thirty percent.

Figure 4:
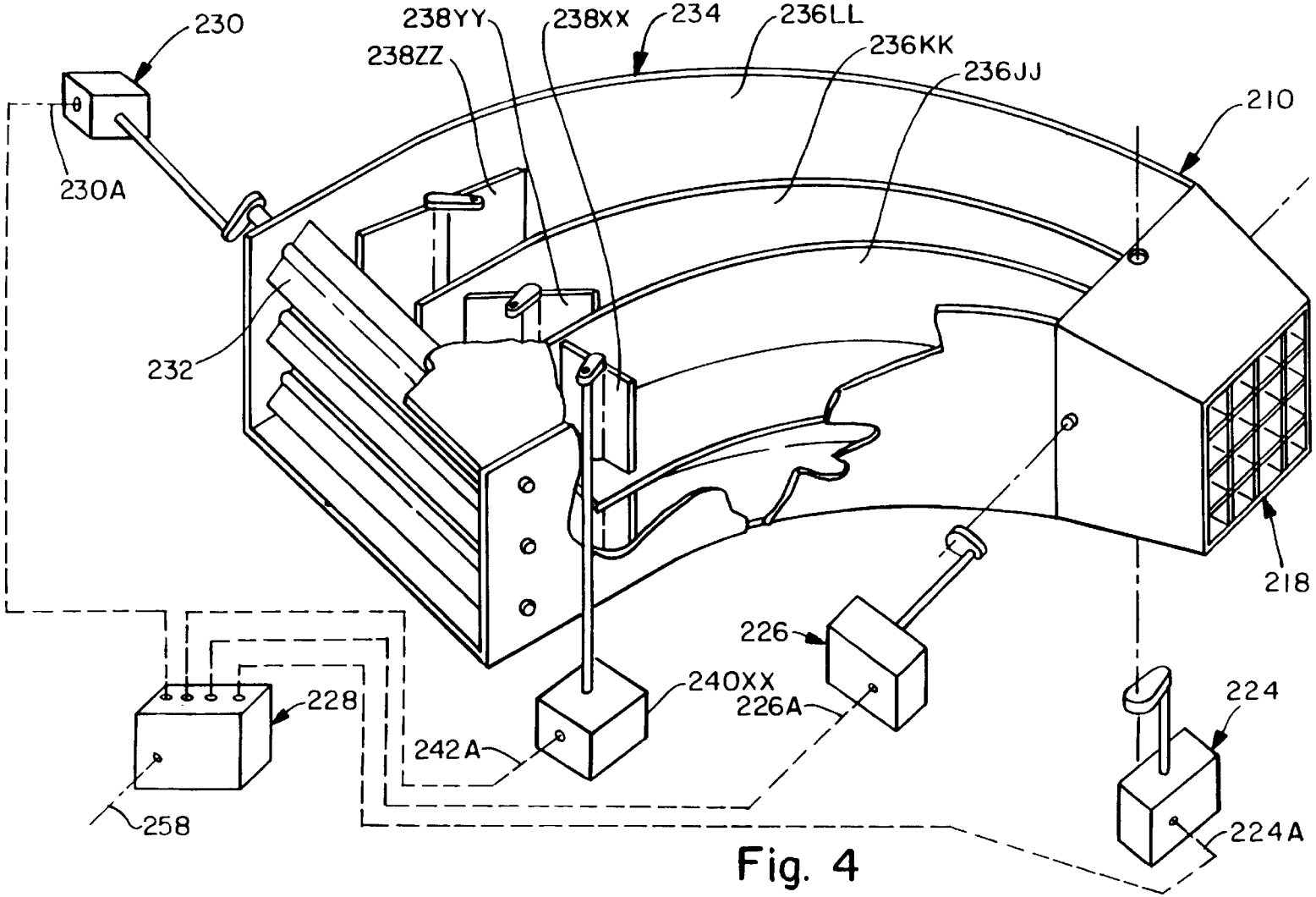
FIG. 4 is an enlarged perspective view of one of the upper air compartments of a windbox of the furnace shown in FIG. 1.

Further details of the upper compartments 210 will now be described with respect to FIG. 4 which is an enlarged perspective view, in partial section, of the respective upper compartment 210 in which the opposition air nozzle 218 is mounted. A conventional yaw assembly 224 and a conventional tilt assembly 226, both schematically shown in FIG. 4, are provided to mount the opposition air nozzle 218 to the upper compartment 210 such that the opposition air nozzle 218 can be moved in a horizontal yaw direction and a vertical tilt direction with respect to the upper compartment 210. The yaw assembly 224 is connected via a lead 224A to a control assembly 228, which may be a computer or other data processing device with the capability of controlling the movement of the yaw assembly 224. The tilt assembly 226 is connected via a lead 226A to the control assembly 228 which also has the capability to control the tilting movement of the opposition air nozzle 218 via control of the tilt assembly 226. A damper assembly 230, which is schematically shown in FIG. 4, is operable to controllable move a series of dampers 232 between progressively more closed positions and progressively more open positions to thereby vary the volume of air supplied to the upper compartment 210. The damper assembly 230 is connected via a lead 230A to the control assembly 228 which has the capability to control the damper assembly 230 so as to selectively vary the volume of air supplied to the upper compartment 210.

The damper assembly 230 regulates or controls the volume of air supplied into a transition section 234 of the upper compartment 210. The transition section 234 has a plurality of channels 236JJ, 236KK, and 236LL and each channel is provided with a flapper 238XX, 238YY, and 238ZZ, respectively, which is operable as a damper or louver to control the volume and velocity of air supplied along the respective channel. Each flapper 238XX, 238YY, and 238ZZ is mechanically linked to a flapper movement assembly which moves the respective flapper between a progressively more closed position and a progressively more open position. In the interest of clarity, only the respective flapper movement assembly 240XX, which is mechanically linked to the flapper 238XX, is schematically shown in FIG. 4 and it is to be understood that the other flapper movement assemblies are identical is operation and configuration although not illustrated.

The flapper movement assembly 240XX is connected via a lead 242A to the control assembly 228 for operational control of the flapper 240XX and the other two flapper movement assemblies are likewise operatively connected to the control assembly 228 for operative control thereby of the respective flappers 238YY and 238ZZ associated with these other two flapper movement assemblies. Thus, different proportions of the air entering the upper compartment 210 can be allocated to the horizontal left, center, and right sides of the opposition air nozzle 218 by controlling the individual extents to which the flappers 238XX, 238YY, and 238ZZ are opened or closed within their respective channels. The allocation of the air proportions to the horizontal left, center, and right sides of the opposition air nozzle 218 in turn affects or influences the placement and velocity of the air which is injected through the opposition air nozzle 218 into the burner region 202. For example, an allocation arrangement in which the flapper 238XX is moved by its associated flapper movement assembly 240XX (under the direction of the control assembly 228) to a relatively more open position while the other two flappers 238YY and 238ZZ are moved to relatively more closed positions will result in a relatively high proportion of the air in the upper compartment 210 being directed through the channel 236JJ to thereby exit through the horizontal left hand side portion of the opposition air nozzle 218 into the burner region 202. The lesser proportion of air in the upper compartment 210 will be guided through the channels 236KK and 236LL to exit through the center and horizontal right hand side portions of the opposition air nozzle 218. Such an air allocation arrangement will effect or influence the placement and velocity of the overall stream of air injected along the air offset direction AO from the upper compartment 210. For example, this air allocation arrangement may result in a decrease in the offset angle of the opposition offset direction OPP, shown in FIG. 2, with the consequence that a relatively greater proportion of the air injected via the upper compartment 210 is redistributed more directly into opposition with the swirling fireball RB and away from the wall extent of the furnace 204 which extends between the first windbox 206A and the second windbox 206B.

Another allocation arrangement in which the flapper 238XX is moved by its associated flapper movement assembly 240XX (under the direction of the control assembly 228) to a relatively more closed position while the other two flappers 238YY and 238ZZ are moved to relatively more open positions will result in a relatively higher proportion of the air in the upper compartment 210 being directed through the channels 236KK and 236LL to thereby exit through the center and horizontal right hand side portion of the opposition air nozzle 218 into the burner region 202. The relatively lesser proportion of air in the upper compartment 210 will be guided through the channel 236JJ to exit through the horizontal left hand side portion of the opposition air nozzle 218. Such an air allocation arrangement will effect or influence the placement and velocity of the overall stream of air injected along the air offset direction AO from the upper compartment 210. For example, this air allocation arrangement may result in an increase in the offset angle of the opposition offset direction OPP, shown in FIG. 2, with the consequence that a relatively lesser proportion of the air injected via the upper compartment 210 is directed into opposition with the swirling fireball RB while a relatively greater proportion of the air is directed along the opposition offset direction OPP, at a relatively increased offset angle thereof, toward the wall extent of the furnace 204 which extends between the first windbox 206A and the second windbox 206B.

Figure 5:
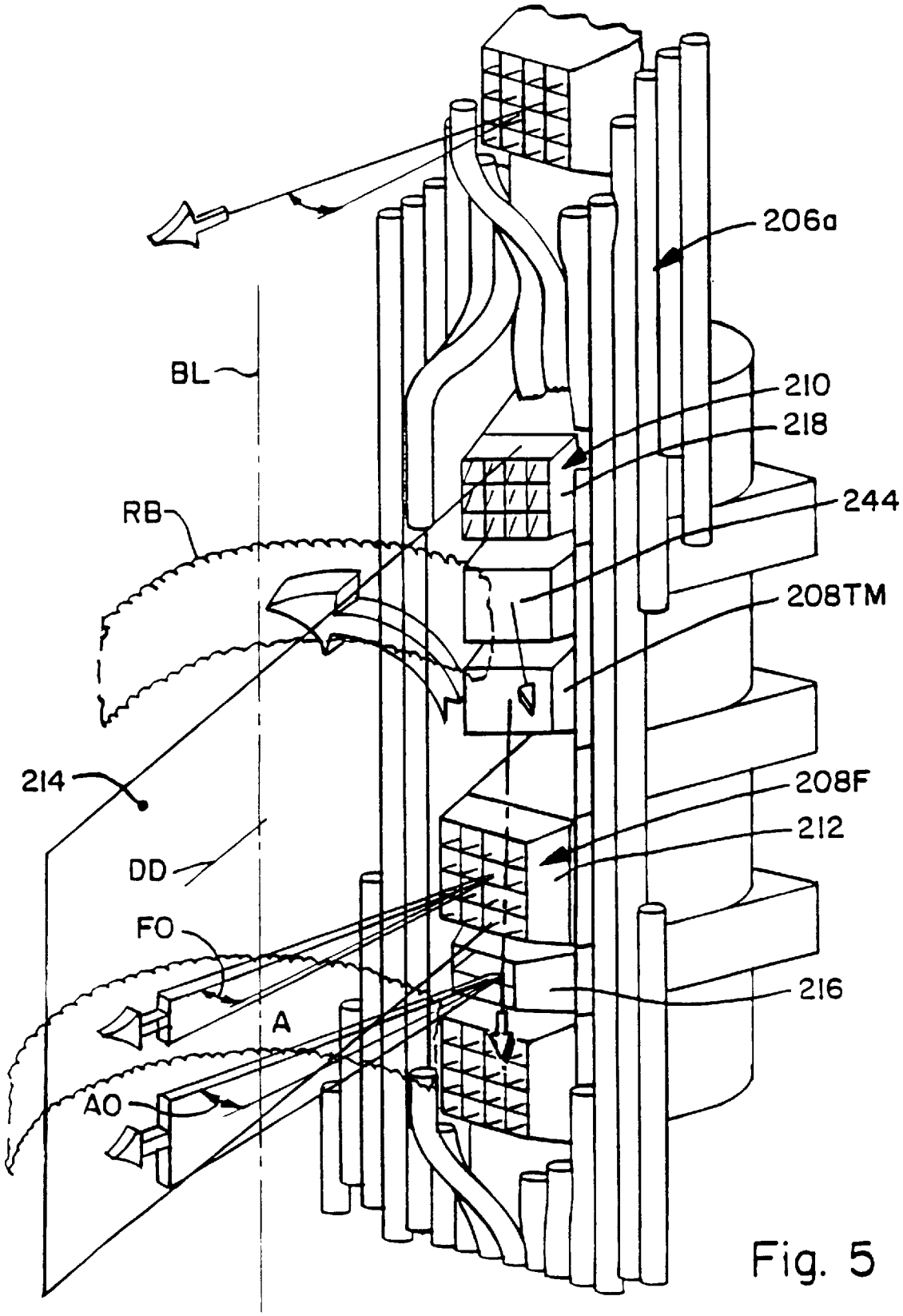
FIG. 5 is an enlarged perspective view of one variation of the corner windboxes of the furnace shown in FIG. 1 and schematically showing a rotating fireball in the furnace.

FIG. 5 illustrates a variation of the method of operating a pulverized coal-firing furnace of the present invention in which a second upper compartment, designated 244, is provided in addition to the upper compartment 210. The second upper compartment 244 is disposed below the other upper compartment 210 and contiguous to the topmost lower compartment 208TM. A combined fuel and air nozzle is mounted in the second upper compartment 244 for introducing a stream of pulverized coal entrained with air into the furnace generally in opposition to the swirling fireball RB along a direction CFO which is offset to the other side of the diagonal DD. The air injected from the upper compartment 210 and the air injected from the second upper compartment 244 into the furnace is preferably a collective amount of between about 10% to 40% of the stoichiometric amount of air required for complete combustion of the fuel tangentially fired into the furnace.

Figure 6:
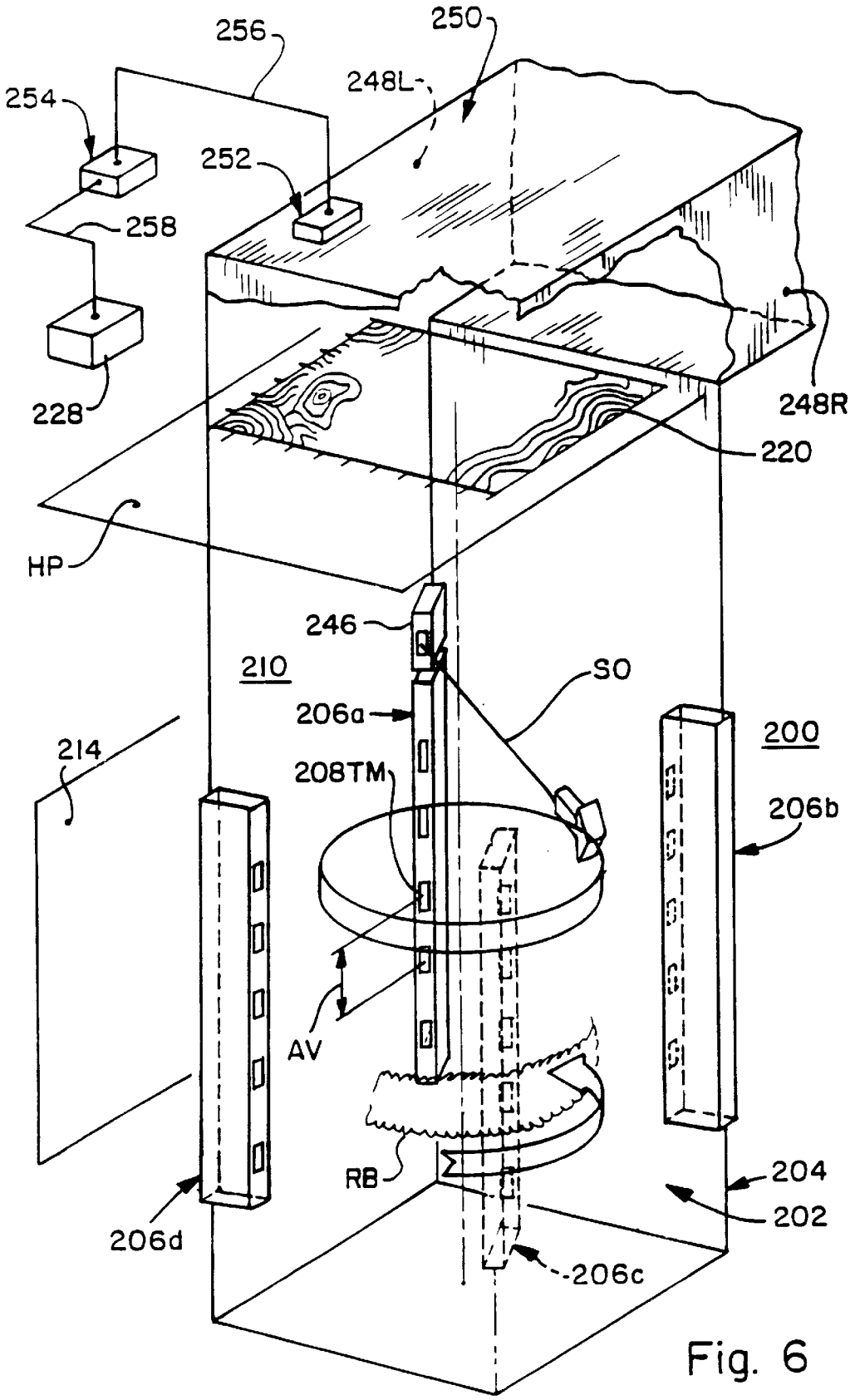
FIG. 6 is an enlarged perspective view of another variation of one of the corner windboxes of the furnace shown in FIG. 1 and schematically showing a rotating fireball in the furnace.

In another variation of the method of operating a pulverized coal-firing furnace of the present invention, as seen in FIG. 6, the furnace 204 is additionally provided with a separated overfire air compartment 246 in the top half TH of the furnace disposed in a location which is not contiguous to the upper compartment 210. The separated overfire air compartment 246 is operable to inject excess air along an separated overfire air offset direction SO which is offset to the other side of the diagonal DD (i.e., the separated overfire air offset direction SO is offset to the same side of the diagonal DD as the opposition offset direction OPP).

Reference will now be had to the embodiment of the furnace 204 shown in FIGS. 1–4 to illustrate an exemplary application of the method of the present invention for operating a pulverized coal-fired furnace, it being understood that the method may be implemented in other applications in a pulverized coal-fired furnace configured as illustrated in FIGS. 1–4 or in other applications in any other suitably configured fossil fuel-fired furnace having a combustion chamber operable to combust fuel in a combustion process which produces flue gas and a convection pass through which the flue gas flows upon exiting the combustion chamber. As will become clear in the discussion of the exemplary application of the method of the present invention, the method of the present invention is effective to modulate or control the non-uniform flow of flue gas into the convective pass of a furnace, thereby mitigating or eliminating the undesirable effects of non-uniform flow such as, for example, a maldistribution of energy absorption by the convective heat exchange surface within the convective pass as a result of the differences in the local heat transfer coefficients. Moreover, the interactive, real time adjustment feature of the method of the present invention permits the convective pass to be designed to accept a limited range of non-uniform temperature profiles which may occur due to the non-uniform flow of flue gas. This feature contributes additional performance and design flexibility to the furnace. On the one hand, the furnace need not be operated to completely suppress the formation of any non-uniform flow of flue gas into the convective pass; this contributes to the performance flexibility of the furnace since this permits a reduction or elimination of interventions such as injecting additional volumes of air in opposition to the swirling fireball, adjustment of the tilt orientation of the injected air or reduction of the load, which would otherwise be needed to completely suppress the formation of any non-uniform flow of flue gas. On the other hand, the materials and construction of the convective pass need not necessarily be constrained to those materials and construction which can withstand the maximum or peak temperature which may be experienced due to an unmodulated non-uniform flow of flue gas in the convective pass. Instead, less expensive materials and construction can be selected with the assurance that the non-uniform flow of flue gas can be sufficiently modulated by application of the method of the present invention so as to prevent the occurrence of the higher temperatures which would otherwise occur with an unmodulated non-uniform flow of flue gas in the convective pass.

The method of the present invention is implemented in the exemplary application of the method by executing a series of steps including tangentially firing fuel from at least one of the series of lower compartments 208, such as the lower fuel compartment 208F, into the combustion chamber 202 at an offset FO from the diagonal DD passing through a respective pair of opposed corners of the combustion chamber (for example, the respective pair of opposed corners at which the first windbox 206A and the third windbox 206C are respectively located). Also, the exemplary application of the method includes the step of tangentially introducing air from the series of lower compartments 208 into the combustion chamber 202 along the direction AO which is offset to the diagonal DD on the same side thereof as the fuel firing offset direction FO. The collective amount of air tangentially introduced through the lower compartments 208 is less than the stoichiometric amount of air required for complete combustion of the fuel tangentially fired into the furnace such that the fuel and air create the swirling fireball RB in the combustion chamber 202.

The exemplary application of the method of the present invention further includes the step of injecting air from the upper compartment 210 generally in opposition to the swirling fireball RB along the direction OPP which is offset to the other side of the diagonal DD. Additionally, the exemplary application of the method includes sensing a temperature characteristic of one side of the convection pass, the temperature characteristic varying as a function of the temperature of the one convection pass location. The temperature characteristic may be, for example, the temperature of the gas flow in the vicinity of the one convection pass location or the temperature of the wall at the location.

Once a value of the temperature characteristic is measured or estimated, the exemplary application of the method of the present invention prescribes the step of determining if the temperature characteristic exceeds an allowable value. Thereafter, in response to a determination that the temperature characteristic exceeds the allowable value, the exemplary application of the method implements the step of comparing the difference between the one convection pass location temperature and a peak temperature to a pre-established buffer difference. The peak temperature is a temperature above which certain undesirable or irreversible events may occur such as, for example, exceeding the design values of the materials or construction of the convection pass. The pre-established buffer difference represents the smallest acceptable difference between the convection pass location temperature and the peak temperature which can be permitted as the convection pass temperature increases in the direction of the peak temperature.

Thereafter, the exemplary application of the method includes the step of changing the momentum of the air injected through the upper air compartment 210 if the difference between the one convection pass location temperature and the peak temperature is less than the buffer difference. For example, this step may include increasing at least one of the yaw angle and the volume of the air injected by the upper air compartment 210. Following this step, the step of sensing the temperature characteristic of the one convection pass location is accomplished to obtain a post adjustment value of the temperature characteristic. If the post adjustment value exceeds the allowable value, then additional adjustments to the characteristics of the air injected by through the upper compartment 210 such as, for example, its momentum or mass flow rate, are undertaken to bring the temperature characteristic of the one convection pass location to a value which does not exceed the allowable value. Preferably, the implementation of the method of the present invention additionally includes the steps of iteratively re-sensing the one convection pass location temperature, re-calculating the one convection pass location temperature-to-peak temperature difference to obtain a revised temperature difference, further increasing at least the yaw angle or the volume of the air injected by the upper air compartment 210, and re-comparing the revised temperature difference to the buffer difference. The re-sensing step, the re-calculating step, the further increasing step, and the re-comparing step are iterated or repeated until the revised temperature difference is greater than the buffer difference.

The following is a description of a hypothetical operational scenario of the operation of the furnace 204 shown in FIGS. 1–4 which illustrates one possible outcome from implementation of the exemplary application of the method of the present invention. As noted, fuel is tangentially fired from at least one of the series of lower compartments 208, such as the lower fuel compartment 208F, into the combustion chamber 202 at an offset FO from the diagonal DD passing through the respective pair of opposed corners at which the first windbox 206A and the third windbox 206C are respectively located. Also, air is tangentially introduced from the series of lower compartments 208 into the combustion chamber 202 along the direction AO which is offset to the diagonal DD on the same side thereof as the fuel firing offset direction FO. The collective amount of air tangentially introduced through the lower compartments 208 is less than the stoichiometric amount of air required for complete combustion of the fuel tangentially fired into the furnace such that the fuel and air create the swirling fireball RB in the combustion chamber 202. Furthermore, in the implementation of the exemplary application of the method of the present invention, air is injected from the upper compartment 210 generally in opposition to the swirling fireball RB along the direction OPP which is offset to the other side of the diagonal DD.

The sensing of a temperature characteristic of one side of the convection pass includes, in this illustrative possible operational scenario, continuously sampling or detecting some temperature characteristics of a selected location of the convective pass and, preferably, includes continuously sampling or detecting the actual temperature of both the right hand side 248R and the left hand side 248L of a reheater metal element 250 of the convective pass (shown in FIG. 6). It can be understood that the right- and left-hand side temperatures of the reheater metal element 250 are temperature characteristics which vary as a function of the temperature of a convection pass location.

An average temperature, standard deviations, and right- and left-hand side maximum and minimum values are then calculated based upon the sampled right- and left-hand side temperatures of the reheater metal element 250. The implementation of the step of determining if the temperature characteristic exceeds an allowable value thereafter involves calculating a respective alarm margin for each of the right- and left-hand sampled temperatures. The alarm margin for each of the right- and left-hand sides of the reheater metal element 250 is established as the difference between an allowable peak temperature—say, 1100 degrees F.—and the respective right- or left-hand sided maximum or peak sampled temperature—say, 880 degrees F. for both sides of the reheater metal element 250. It will be recalled that the peak temperature is a temperature above which certain undesirable or irreversible events may occur such as, for example, exceeding the design values of the materials or construction of the convection pass. If the allowable peak temperature is, say, 1100 degrees F. and the respective right- or left-hand sided maximum or peak sampled temperatures are, say, 880 degrees F., then the alarm margin for each of the right- and left-hand sides of the reheater metal element 250 would be established as: (1100−880)=220.

The thus established alarm margin of 220 is then compared to an operator selected preferred temperature differential (the pre-established buffer difference) which represents the minimum temperature differential which the operator is willing to accept between the allowable peak temperature and the respective side temperature of the reheater metal element 250. If, for example, this operator designated preferred minimum temperature differential is 250 degrees F., it can be seen that the initially established alarm margin of 220 degrees F. is unacceptably less than the preferred minimum temperature differential.

In response to this initial determination of an unacceptable small alarm margin, the step of changing the momentum of the air injected through the upper air compartment 210 is implemented by increasing the yaw of the air nozzle in the upper air compartment 210.

Thereafter, the step of sensing the temperature characteristic of the one convection pass location to obtain a post adjustment value of the temperature characteristic is implemented by re-calculating the change in the alarm margins for the right- and left-hand sides of the reheater metal element 250 and, additionally, monitoring the standard deviations of the full profile for a period of five minutes to allow equilibration of the new flow distribution of the flue gas through the reheater metal element 250. If the post adjustment values of the alarm margins now at least equal the pre-established buffer difference of 250 degrees F., no further adjustments of the momentum of the air injected by the upper air compartment 210 are undertaken. On the other hand, if the post adjustment values of the alarm margins still exceeds the allowable preestablished buffer difference of 250 degrees F., another adjustment is undertaken of the yaw of the air nozzle injecting air from the upper compartment 210 and the alarm margins and standard deviation are again re-calculated and monitored. If this information indicates that the rate of change of both the right- and left-hand side alarm margins is less than a predefined effectiveness factor, which indicates if the increased momentum fraction of the injected air due to the incremental change in the yaw angle is sufficient, a signal is provided to indicate this status and the operator may discretionarily increase, for example, the volume of air injected via a separated overfire air compartment, if the furnace is so equipped. Otherwise, the steps of iteratively re-sensing the right- and left-hand side temperatures, re-calculating the alarm margins, further increasing at least the yaw angle or the volume of the air injected by the upper air compartment 210, and re-comparing the revised temperature difference to the buffer difference is iterated or repeated until the alarm margins are greater than the buffer difference of 250 degrees F.

The pulverized coal-fired furnace 204 can be operated manually to implement the method of the present invention or can be operated in an automatic manner. The furnace may be provided with appropriate sensing and control units to operate the furnace 204 in a manual or automatic manner so as to implement the method of the present invention. For example, as seen in FIG. 6, the furnace 204 can be provided with means for sensing a temperature characteristic of one side of the convection pass in the form of a thermocouple 252 or other suitable temperature sensing device. Also, the furnace 204 can be provided with means for determining if the sensed value of the temperature characteristic exceeds the allowable value in the form of a PC-based controller or a logic controller 254 which is operatively connected to the thermocouple 252 via a lead 256 to receive temperature signals therefrom. The controller 254 may also be operatively connected to the controller 228 via a lead 258 to provide signals to the controller 228 to effect a change in the momentum of the air injected through the at least one upper air compartment in response to a determination that the temperature characteristic exceeds the allowable value. The means for sensing a temperature characteristic of one side of the convection pass in the form of the thermocouple 252 is preferably also operable to obtain a post adjustment value of the temperature characteristic after a change in the momentum of the air injected through the at least one upper air compartment and the means for determining being means for determining if the sensed value of the temperature characteristic exceeds the allowable value in the form of the PC-based controller or a logic controller 254 is preferably operable to subsequently determine if the post adjustment value exceeds the allowable value.

While several embodiments of the invention have been shown, it will be appreciated that modifications thereof, some of which have been alluded to hereinabove, may still be readily made thereto by those skilled in the art. It is, therefore, intended that the appended claims shall cover the modifications alluded to herein as well as all the other modifications which fall within the true spirit and scope of the present invention.

What is claimed is:

1. A method for operating a pulverized coal-fired furnace having a combustion chamber operable to combust fuel in a combustion process which produces flue gas and a convection pass through which the flue gas flows upon exiting the combustion chamber, the combustion chamber having four corners each substantially equidistant from adjacent corners such that the combustion chamber has a substantially square cross section and at least one of the four corners of the combustion, chamber having a series of lower compartments for introducing therethrough one of air, fuel and air and fuel into the combustion chamber and at least one upper compartment for introducing air into the combustion chamber comprising the steps of:

a) tangentially firing fuel from at least one of the series of lower compartments into the combustion chamber at an offset from a diagonal passing through a pair of opposed corners of the combustion chamber;

b) tangentially introducing air from the series of lower compartments into the combustion chamber along a direction which is offset to the diagonal on the same side thereof as the fuel firing offset direction, the collective amount of air tangentially introduced through the lower compartments being less than the stoichiometric amount of air required for complete combustion of the fuel tangentially fired into the furnace such that the fuel and air create a swirling fireball in the combustion chamber;

c) injecting air from the at least one upper compartment generally in opposition to the swirling fireball along a direction which is offset to the other side of the diagonal;

d) sensing a temperature characteristic of one side of the convection pass, the temperature characteristic varying as a function of the temperature of the one convection pass location;

e) determining if the sensed value of the temperature characteristic exceeds an allowable value including comparing the difference between the one convection pass location temperature and a peak temperature to a pre-established buffer difference which represents the smallest acceptable difference between the convection pass location temperature and the peak temperature which can be permitted as the convection pass temperature increases in the direction of the peak temperature;

f) in response to a determination that the temperature characteristic exceeds the allowable value, changing the momentum of the air injected through the at least one upper air compartment; and g) after the step of changing the momentum of the air injected through the at least one upper air compartment, sensing the temperature characteristic of the one convection pass location to obtain a post adjustment value of the temperature characteristic and subsequently determining if the post adjustment value exceeds the allowable value and, if the post adjustment value does not exceed the allowable value, iteratively re-sensing the one convection pass location temperature, re-calculating the one convection pass location temperature-to-peak temperature difference to obtain a revised temperature difference, further increasing at least one of a yaw angle and a volume of the air injected by the at least one upper air compartment, and re-comparing the revised temperature difference to the buffer difference until the revised temperature difference is greater than the buffer difference.

2. A method for operating a pulverized coal-fired furnace according to claim 1 wherein sensing the temperature characteristic of the one convection pass location includes sensing an instantaneous temperature of the convection pass location.

3. A method for operating a pulverized coal-fired furnace according to claim 1 wherein changing the momentum of the air injected through the at least one upper air compartment includes increasing at least one of a yaw angle and a volume of the air injected by the at least one upper air compartment if the one convection pass location temperature-to-peak temperature difference is less than the buffer difference.

4. A method for operating a pulverized coal-fired furnace according to claim 1 wherein the at least one upper compartment is disposed above the topmost compartment of the series of lower compartments at a relative disposition to the topmost compartment in a spacing range between a contiguous disposition to a more spaced disposition which is less than or equal to twice an average spacing between any given compartment and an adjacent compartment and injecting air from the at least one upper compartment generally in opposition to the swirling fireball includes injecting air in amount of between about 20 to 50 percent of the air required for combustion.

5. A method for operating a pulverized coal-fired furnace according to claim 1 wherein the collective amount of air tangentially introduced through the lower compartments is less than the stoichiometric amount of air required for complete combustion of the fuel tangentially fired into the furnace such that the fuel and air create the swirling fireball in the combustion chamber with an upward flow in the top half of the furnace characterized by portions thereof flowing upward at differing vertical velocities with a maximum variation of no more than thirty percent between the instantaneous vertical velocities of the portions of the upward flow as measured across a horizontal plane in the top half of the furnace.

6. A method for operating a pulverized coal-fired furnace according to claim 5 wherein the step of injecting air from the at least one upper compartment includes injecting air in an amount of between about 10% to 40% of the stoichiometric amount of air required for complete combustion of the fuel tangentially fired into the furnace.

7. A method for operating a pulverized coal-fired furnace having a combustion chamber operable to combust fuel in a combustion process which produces flue gas and a convection pass through which the flue gas flows upon exiting the combustion chamber, the combustion chamber having four corners each substantially equidistant from adjacent corners such that the combustion chamber has a substantially square cross section and at least one of the four corners of the combustion chamber having a series of lower compartments for introducing therethrough one of air, fuel, and air and fuel into the combustion chamber and at least one upper compartment for introducing air into the combustion chamber comprising the steps of:

a) tangentially firing fuel from at least one of the series of lower compartments into the combustion chamber at an offset from a diagonal passing through a pair of opposed corners of the combustion chamber;

b) tangentially introducing air from the series of lower compartments into the combustion chamber along a direction which is offset to the diagonal on the same side thereof as the fuel firing offset direction, the collective amount of air tangentially introduced through the lower compartments being less than the stoichiometric amount of air required for complete combustion of the fuel tangentially fired into the furnace such that the fuel and air create a swirling fireball in the combustion chamber;

c) injecting air from the at least one upper compartment generally in opposition to the swirling fireball along a direction which is offset to the other side of the diagonal;

d) sensing the instantaneous temperature of one side of the convection pass;

e) determining if the sensed value of the temperature characteristic exceeds an allowable value including comparing the difference between the one convection pass location temperature and a peak temperature to a pre-established buffer difference which represents the smallest acceptable difference between the convection pass location temperature and the peak temperature which can be permitted as the convection pass temperature increases in the direction of the peak temperature;

f) in response to a determination that the temperature characteristic exceeds the allowable value, changing the momentum of the air injected through the at least one upper air compartment including increasing at least one of the yaw angle and the volume of the air injected by the at least one upper air compartment if the one convection pass location temperature-to-peak temperature difference is less than the buffer difference; and g) after the step of changing the momentum of the air injected through the at least one upper air compartment, sensing the temperature characteristic of the one convection pass location to obtain a post adjustment value of the temperature characteristic and subsequently determining if the post adjustment value exceeds the allowable value including iteratively re-sensing the one convection pass location temperature, re-calculating the one convection pass location temperature-to-peak temperature difference to obtain a revised temperature difference, further increasing at least one of a yaw angle and a volume of the air injected by the at least one upper air compartment, and re-comparing the revised temperature difference to the buffer difference until the revised temperature difference is greater than the buffer difference.

* * * * *